US010670272B2

(12) United States Patent
Cunha et al.

(10) Patent No.: US 10,670,272 B2
(45) Date of Patent: Jun. 2, 2020

(54) FUEL INJECTOR GUIDE(S) FOR A TURBINE ENGINE COMBUSTOR

(71) Applicant: United Technologies Corporation, Hartford, CT (US)

(72) Inventors: Frank J. Cunha, Avon, CT (US); Stanislav Kostka, Shrewsbury, MA (US)

(73) Assignee: Raytheon Technologies Corporation, Farmington, CT (US)

( * ) Notice: Subject to any disclaimer, the term of this patent is extended or adjusted under 35 U.S.C. 154(b) by 963 days.

(21) Appl. No.: 14/939,667

(22) Filed: Nov. 12, 2015

(65) Prior Publication Data

US 2016/0169522 A1 Jun. 16, 2016

Related U.S. Application Data

(60) Provisional application No. 62/090,664, filed on Dec. 11, 2014.

(51) Int. Cl.
*F23R 3/28* (2006.01)
*F23R 3/10* (2006.01)

(52) U.S. Cl.
CPC ..... *F23R 3/283* (2013.01); *F23R 3/10* (2013.01); *F23R 2900/03043* (2013.01); *F23R 2900/03044* (2013.01); *F23R 2900/03045* (2013.01)

(58) Field of Classification Search
CPC .. F23R 3/002; F23R 3/10; F23R 3/283; F23R 2900/03043–03045; F23R 2900/03041–03042; F23R 3/44; F23R 3/46
See application file for complete search history.

(56) References Cited

U.S. PATENT DOCUMENTS 3,628,885 A * 12/1971 Sidenstick ..... F01D 5/189 416/217
4,365,470 A 12/1982 Matthews et al.
4,686,823 A 8/1987 Coburn et al.
4,870,818 A 10/1989 Suliga
4,914,918 A * 4/1990 Sullivan ..... F23D 11/36 60/756
4,934,145 A * 6/1990 Zeisser ..... F23R 3/002 60/740
5,395,212 A * 3/1995 Anzai ..... F01D 5/187 415/115
5,400,491 A 3/1995 Yaworsky et al.
5,419,115 A 5/1995 Butler et al.
5,581,999 A 12/1996 Johnson
(Continued)

OTHER PUBLICATIONS

Office action for EP15199626.1 dated Jul. 27, 2017.
Extended EP Search Report dated Apr. 15, 2016.

*Primary Examiner* — Gerald L Sung
*Assistant Examiner* — Rene D Ford
(74) *Attorney, Agent, or Firm* — Getz Balich LLC

(57) ABSTRACT

A fuel injector guide is provided for a turbine engine combustor. The fuel injector guide includes a tubular base, an annular flange, a plurality of ribs and a flow turbulator. The base extends along an axis between first and second ends. The flange extends radially out from the base at the second end. The ribs are disposed around the base and extend axially out from the flange towards the first end. The flow turbulator is disposed between an adjacent pair of the ribs.

14 Claims, 8 Drawing Sheets

(56) References Cited

U.S. PATENT DOCUMENTS

| | | | | |
|---|---|---|---|---|
| 5,681,144 | A * | 10/1997 | Spring | F01D 5/187 415/115 |
| 6,032,457 | A | 3/2000 | McKinney et al. | |
| 6,164,074 | A | 12/2000 | Madden et al. | |
| 6,751,961 | B2 | 6/2004 | Pacheco-Tougas et al. | |
| 6,978,618 | B2 | 12/2005 | Pacheco-Tougas et al. | |
| 7,730,725 | B2 * | 6/2010 | Faulder | F23R 3/002 60/752 |
| 8,689,563 | B2 | 4/2014 | Low | |
| 2011/0203294 | A1 | 8/2011 | Cameriano et al. | |
| 2013/0318975 | A1 * | 12/2013 | Stoia | F23R 3/283 60/737 |
| 2014/0020393 | A1 * | 1/2014 | Nakamata | F23R 3/002 60/754 |
| 2014/0021292 | A1 * | 1/2014 | West | F02C 7/20 244/54 |
| 2014/0090402 | A1 | 4/2014 | Erbas-Sen et al. | |
| 2014/0096527 | A1 | 4/2014 | Bangerter et al. | |

* cited by examiner

FUEL INJECTOR GUIDE(S) FOR A TURBINE ENGINE COMBUSTOR

This application claims priority to U.S. Patent Appln. No. 62/090,664 filed Dec. 11, 2014.

BACKGROUND

1. Technical Field

This disclosure relates generally to a turbine engine and, more particularly, to a fuel injector guide for a turbine engine combustor.

2. Background Information

A combustor assembly for a turbine engine may include a plurality of fuel injector guides. These fuel injector guides are typically attached to a combustor bulkhead and respectively receive a plurality of fuel injectors. The fuel injector guides may maintain proper alignment between the fuel injectors and other combustor assembly features such as igniters, quench apertures, etc. The fuel injector guides may also aid in mating the fuel injectors with the bulkhead as well as at least partially seal any gaps between the fuel injectors and the bulkhead.

During turbine engine operation, a flange of each fuel injector guide is typically subject to relatively high temperature gases; e.g., combusting gases. These high temperature gases may subject the flange to relatively high thermal loads and stresses as well as cause the flange to thermally deform. Such thermal loads, stresses and deformation may reduce or prevent proper fuel injector guide operation and service life.

There is a need in the art for an improved fuel injector guide and combustor assembly.

SUMMARY OF THE DISCLOSURE

According to an aspect of the invention, a fuel injector guide is provided for a turbine engine combustor. This fuel injector guide includes a tubular base, an annular flange, a plurality of ribs and a flow turbulator. The base extends along an axis between first and second ends. The flange extends radially out from the base at the second end. The ribs are disposed around the base and extend axially out from the flange towards the first end. The flow turbulator is disposed between an adjacent pair of the ribs.

According to another aspect of the invention, an assembly is provided for a turbine engine combustor. This combustor assembly includes a bulkhead and a fuel injector guide, which includes a base, a flange, a plurality of ribs and a flow turbulator. The base projects through the bulkhead along an axis and away from the flange. The ribs are disposed around the base axially between the flange and the bulkhead. The flow turbulator is disposed between an adjacent pair of the ribs.

According to still another aspect of the invention, another assembly is provided for a turbine engine combustor. This combustor assembly includes a bulkhead with a plurality of impingement apertures. The combustor assembly also includes a fuel injector guide and a flow turbulator. The fuel injector guide includes a base and a flange. The base extends through the bulkhead along an axis and away from the flange. A plurality of radially extending flow channels are axially between the flange and the bulkhead and disposed around the base. The flow channels are fluidly coupled with the impingement apertures. The flow turbulator extend partially axially into one of the flow channels.

The fuel injector guide may include a plurality of ribs and the flow turbulator. Each of the flow channels may be laterally bound by a respective adjacent pair of the ribs. Alternatively, the flow turbulator may be connected to or included with the bulkhead.

The assembly may be configured to impinge air against or otherwise direct air onto the flange radially between the base and the flow turbulator.

An aperture may extend through the bulkhead. This aperture may be operable to direct air radially between the base and the flow turbulator.

An aperture may extend through the fuel injector guide. This aperture may be operable to direct air radially between the base and the flow turbulator.

An aperture may extend through the fuel injector guide. This aperture may be operable to direct air radially between the base and the flow turbulator.

The adjacent pair of the ribs may axially engage the bulkhead. The flow turbulator may be axially separated from the bulkhead by a gap.

The flow turbulator may have an axial thickness less than an axial thickness of each of the adjacent pair of the ribs.

The flow turbulator may be configured as or otherwise include a trip strip.

The flow turbulator may be configured as or otherwise include a pedestal.

The flow turbulator may be one of a plurality of flow turbulators between the adjacent pair of the ribs. Each of the flow turbulators may have substantially identical configurations. Alternatively, one of the flow turbulators may have a different configuration than another one of the flow turbulators.

A second flow turbulator may be disposed between another adjacent pair of the ribs. The flow turbulator and the second flow turbulator may have substantially identical configurations. Alternatively, the flow tabulator and the second flow turbulator may have different configurations.

The ribs may extend radially towards and/or to an outer peripheral edge of the flange.

A first of the adjacent pair of the ribs has a first radial length. A second of the adjacent pair of the ribs has a second radial length that may be different than the first radial length. Alternatively, the second radial length may be substantially equal to the first radial length.

A passage may extend axially through a sidewall of the base to an outlet at the second end.

An annular retainer may be included and attached to the base at the first end. An annular channel may extend axially within the fuel injector guide between the flange and the retainer.

The foregoing features and the operation of the invention will become more apparent in light of the following description and the accompanying drawings.

DETAILED DESCRIPTION

Figure 1:
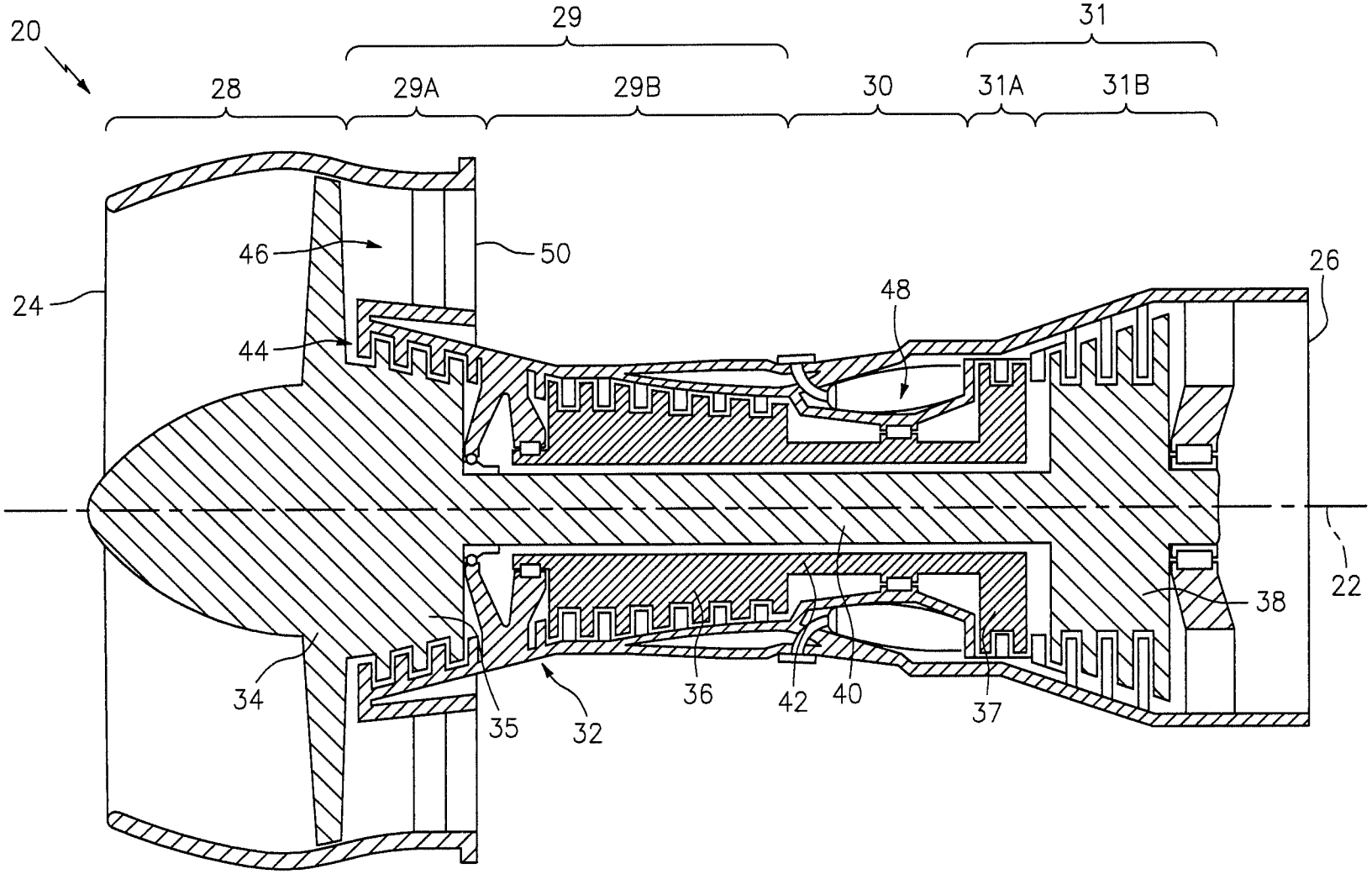
FIG. 1 is a side sectional illustration of a turbofan turbine engine.

FIG. 1 schematically illustrates a turbofan turbine engine 20. This turbine engine 20 extends along a centerline 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B.

The engine sections 28-31 are arranged sequentially along the centerline 22 within an engine housing 32. Each of the engine sections 28, 29A, 29B, 31A and 31B includes a respective rotor 34-38. Each of these rotors 34-38 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 34 and the LPC rotor 35 are connected to and driven by the LPT rotor 38 through a low speed shaft 40. The HPC rotor 36 is connected to and driven by the HPT rotor 37 through a high speed shaft 42. The shafts 40 and 42 are respectively rotatably supported by a plurality of bearings; e.g., rolling element and/or thrust bearings. Each of these bearings may be connected to the engine housing 32 by at least one stationary structure such as, for example, an annular support strut.

During operation, air enters the turbine engine 20 through the airflow inlet 24, and is directed through the fan section 28 and into a core gas path 44 and a bypass gas path 46. The air within the core gas path 44 may be referred to as "core air". The air within the bypass gas path 46 may be referred to as "bypass air". The core air is directed through the engine sections 29-31, and exits the turbine engine 20 through the airflow exhaust 26 to provide forward engine thrust. Within the combustor section 30, fuel is injected into a combustion chamber 48 and mixed with the core air. This fuel-core air mixture is ignited to power the turbine engine 20. The bypass air is directed through the bypass gas path 46 and out of the turbine engine 20 through a bypass nozzle 50 to provide additional forward engine thrust, which may account for the majority of the forward engine thrust. Alternatively, at least some of the bypass air may be directed out of the turbine engine 20 through a thrust reverser to provide reverse engine thrust.

Figure 2:
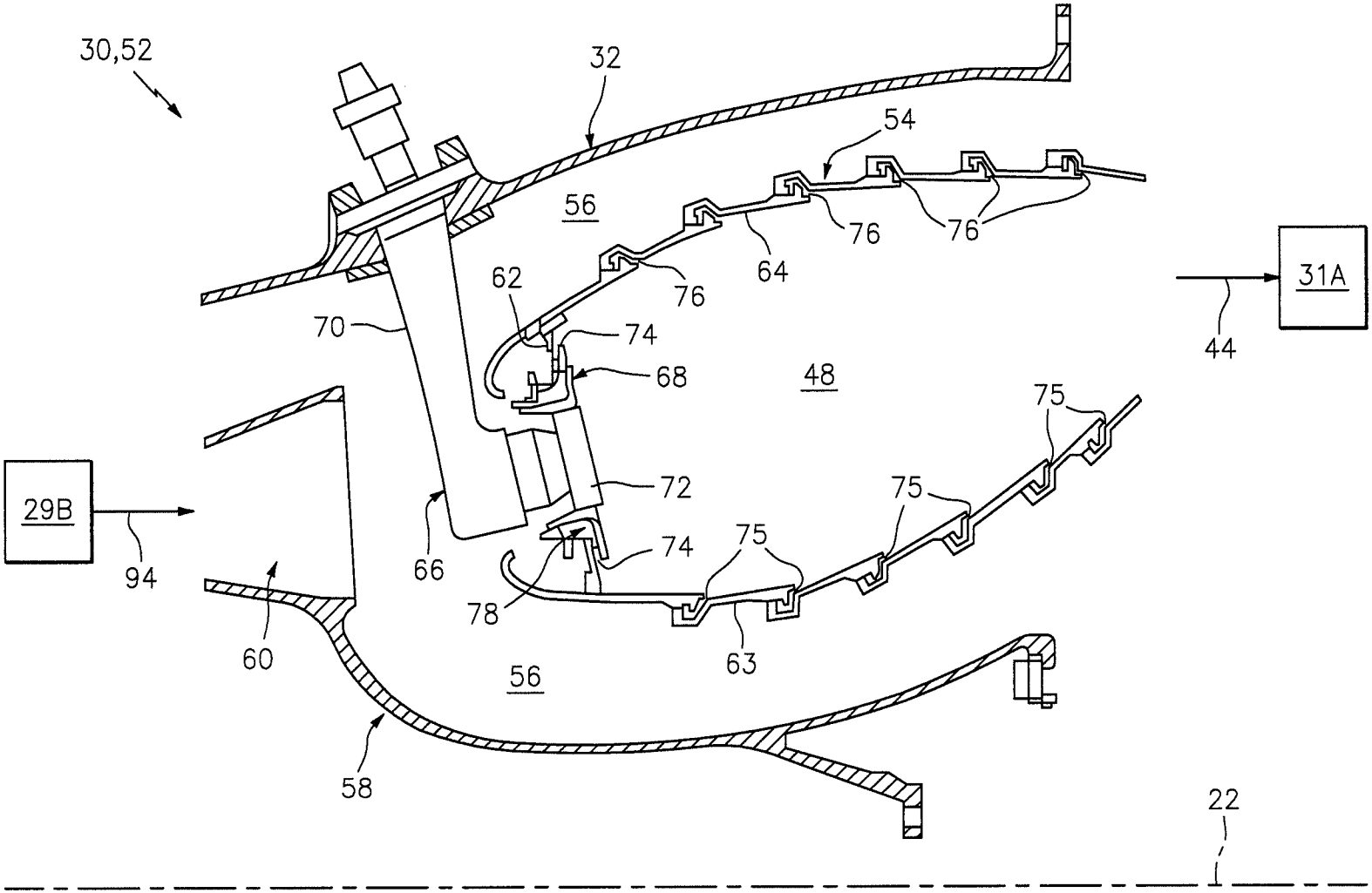
FIG. 2 is a partial side sectional illustration of a combustor assembly.

FIG. 2 illustrates a combustor assembly 52 of the turbine engine 20. This combustor assembly 52 includes a combustor 54 arranged within a combustor plenum 56 of a diffuser module 58. The plenum 56 receives compressed core air from the HPC section 29B through an inlet passage 60 of the diffuser module 58. The plenum 56 provides the received core air to the combustor 54 as described below in further detail.

The combustor 54 may be configured as an annular combustor. The combustor 54 of FIG. 2, for example, includes an annular combustor bulkhead 62, a tubular combustor inner wall 63, and a tubular combustor outer wall 64. The bulkhead 62 extends between and is connected to the inner wall 63 and the outer wall 64. Each wall 63, 64 extends along the centerline 22 from the bulkhead 62 towards the HPT section 31A, thereby defining the combustion chamber 48. Each of the foregoing combustor components 62-64 may be configured as a single walled structure or a multi-walled structure. Where configured as a multi-walled structure, that component may include an interior heat shield connected to an exterior shell with one or more cooling cavities and/or cooling passages therebetween.

Referring still to FIG. 2, the combustor assembly 52 also includes one or more fuel injector assemblies 66 and one or more fuel injector guides 68, which may also be referred to as fuel nozzle guides. The fuel injector assemblies 66 are arranged around the centerline 22. Each of these fuel injector assemblies 66 includes a fuel injector 70 which may be mated with a swirler 72.

The fuel injector 70 injects the fuel into the combustion chamber 48. The swirler 72 directs some of the core air from the plenum 56 into the combustion chamber 48 in a manner that facilitates mixing the core air with the injected fuel. One or more igniters (not shown) ignite the fuel-core air mixture. Quench apertures (not shown) in the inner and/or outer walls 63 and 64 may direct additional core air into the combustion chamber 48 for combustion. Additional core air is directed into the combustion chamber 48 through one or more cooling apertures 74-76 in the combustor components 62-64.

Figure 3:
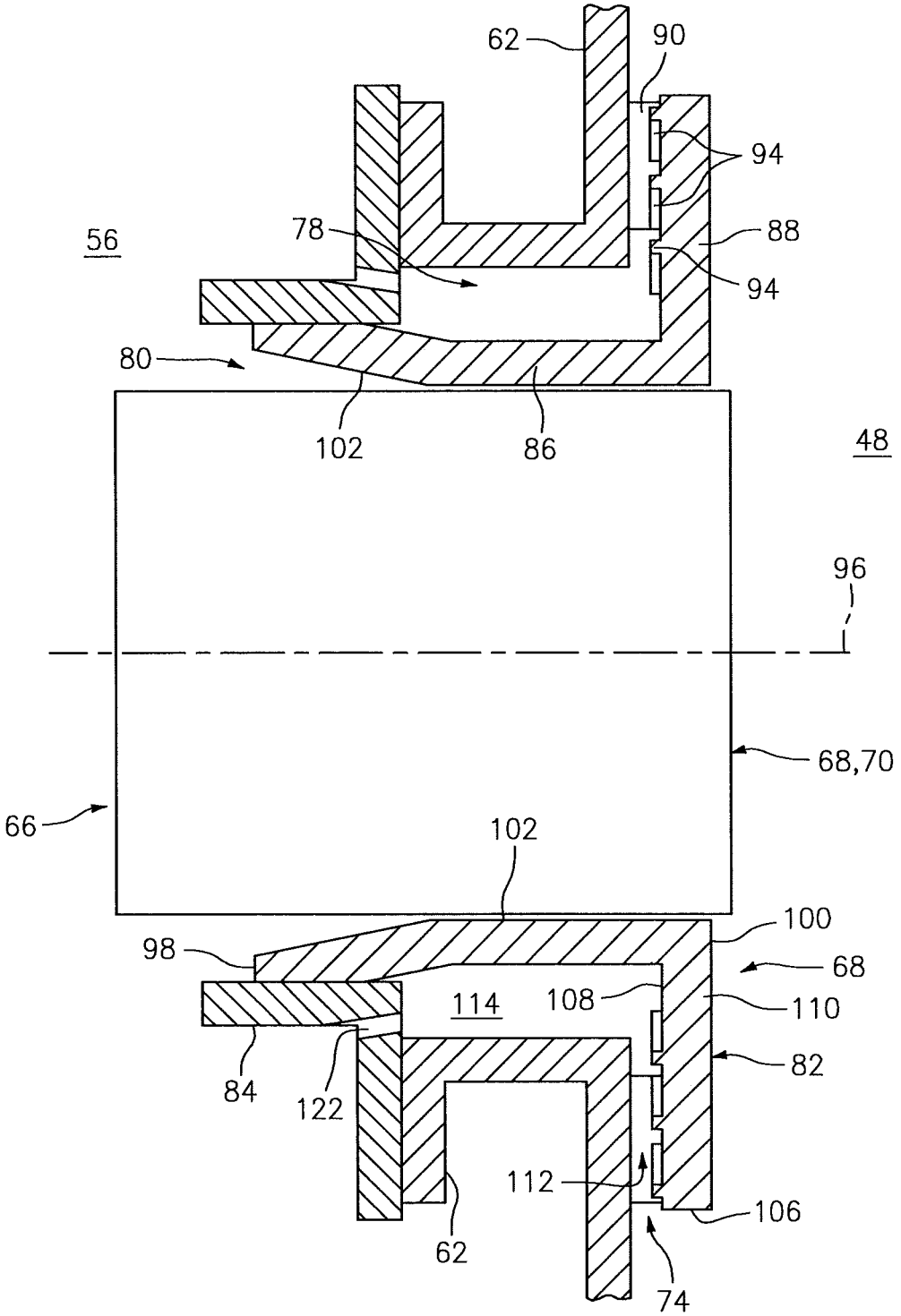
FIG. 3 is an enlarged side sectional illustration of a portion of the combustor assembly of FIG. 2.

Referring to FIG. 3, the fuel injector guides 68 are respectively arranged with the fuel injector assemblies 66. Each of the fuel injector guides 68 is nested with a respective aperture 78 in the bulkhead 62. Each fuel injector guide 68 receives a respective one of the fuel injector assemblies 66 in a central bore 80. Each fuel injector guide 68 may be configured to align the respective fuel injector assembly 66 with one or more other combustor features such as the igniter(s), the quench aperture(s), etc. Each fuel injector guide 68 may also or alternatively be configured to seal an annular gap between the respective fuel injector assembly 66 (e.g., the swirler 72) and the bulkhead 62.

The fuel injector guide 68 of FIG. 3 includes a guide/shield structure 82 as well as an annular retainer 84 for attaching the guide/shield structure 82 to the bulkhead 62. The fuel injector guide 68 of the present disclosure, however, is not limited to including such a retainer 84 or any particular attachment schemes. For example, the guide/shield structure 82 may also or alternatively be bonded (e.g., brazed, welded, adhered) and/or fastened with one or more fasteners (e.g., bolts or studs) to the bulkhead 62.

Figure 5:
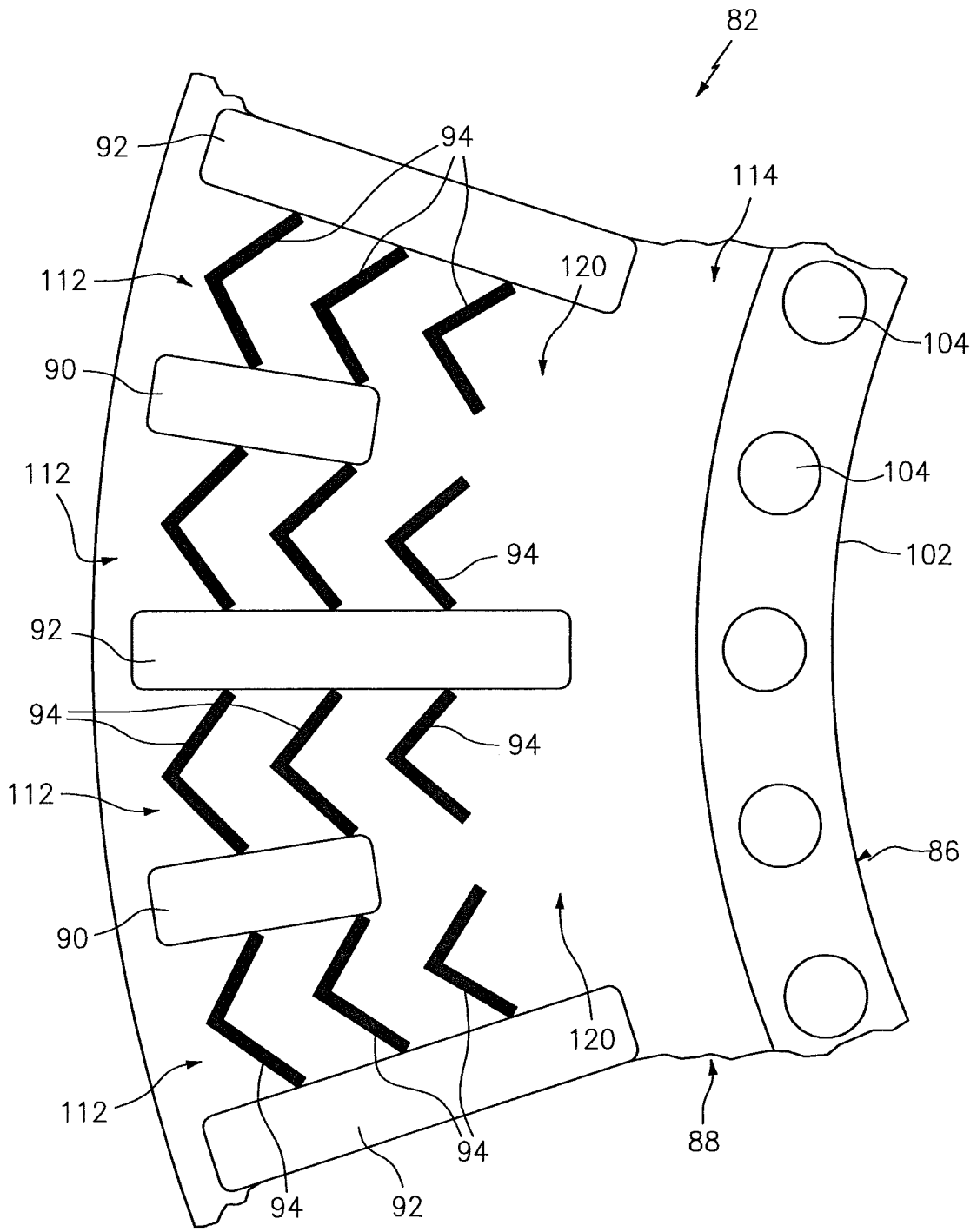
FIG. 5 is an enlarged upstream view illustration of a portion of the guide/shield structure of FIG. 4.
Figure 6:
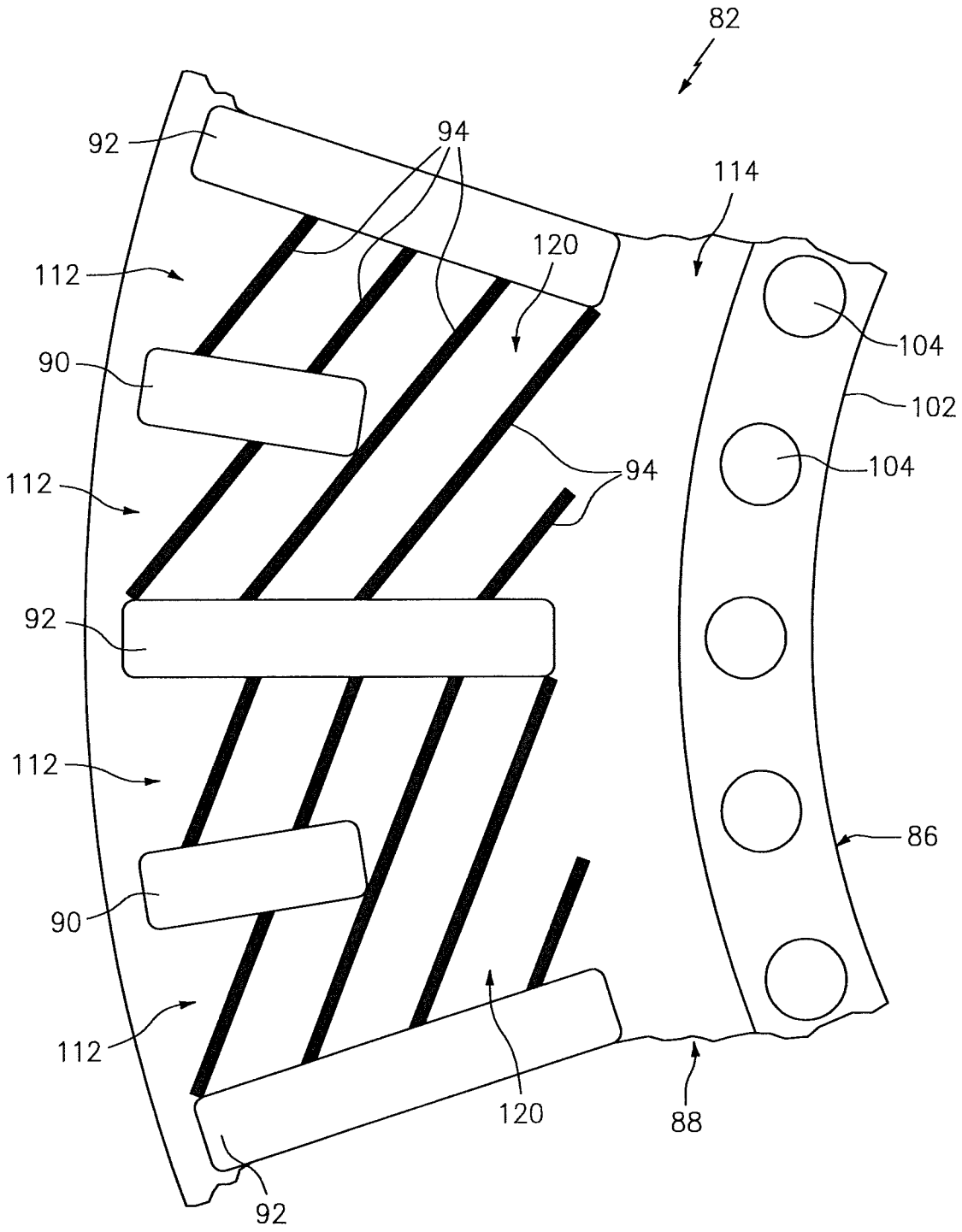
FIG. 6 is an enlarged upstream view illustration of a portion of another guide/shield structure for a fuel injector guide.
Figure 7:
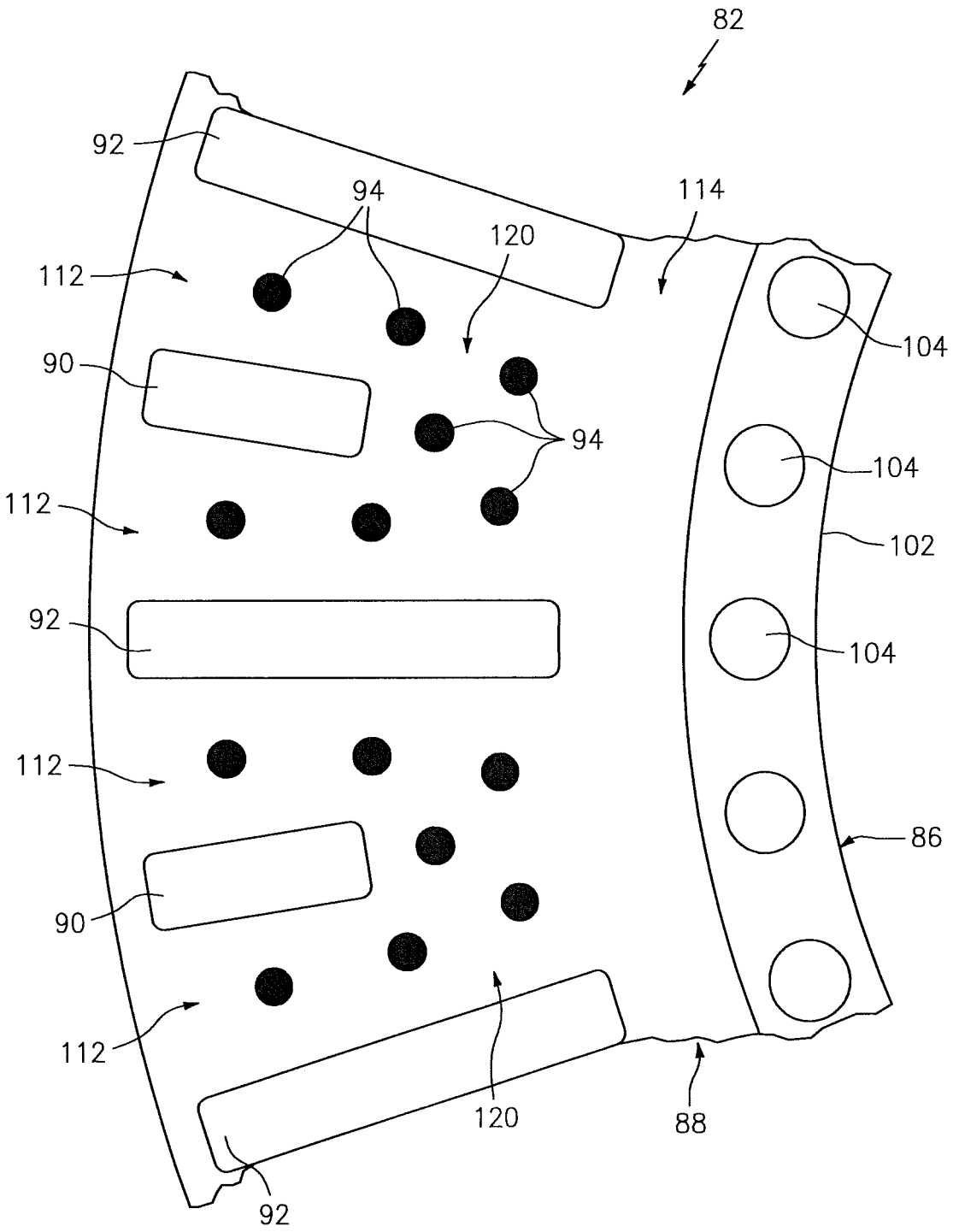
FIG. 7 is an enlarged upstream view illustration of a portion of still another guide/shield structure for a fuel injector guide.

The guide/shield structure 82 includes a tubular base 86, an annular flange 88, a plurality of ribs 90, 92 and one or more flow turbulators 94. It is worth noting, while FIG. 5 shows the guide/shield structure 82 without the flow turbulators 94 for ease of illustration, further flow turbulator 94 details are shown in FIG. 5-7.

Figure 4:
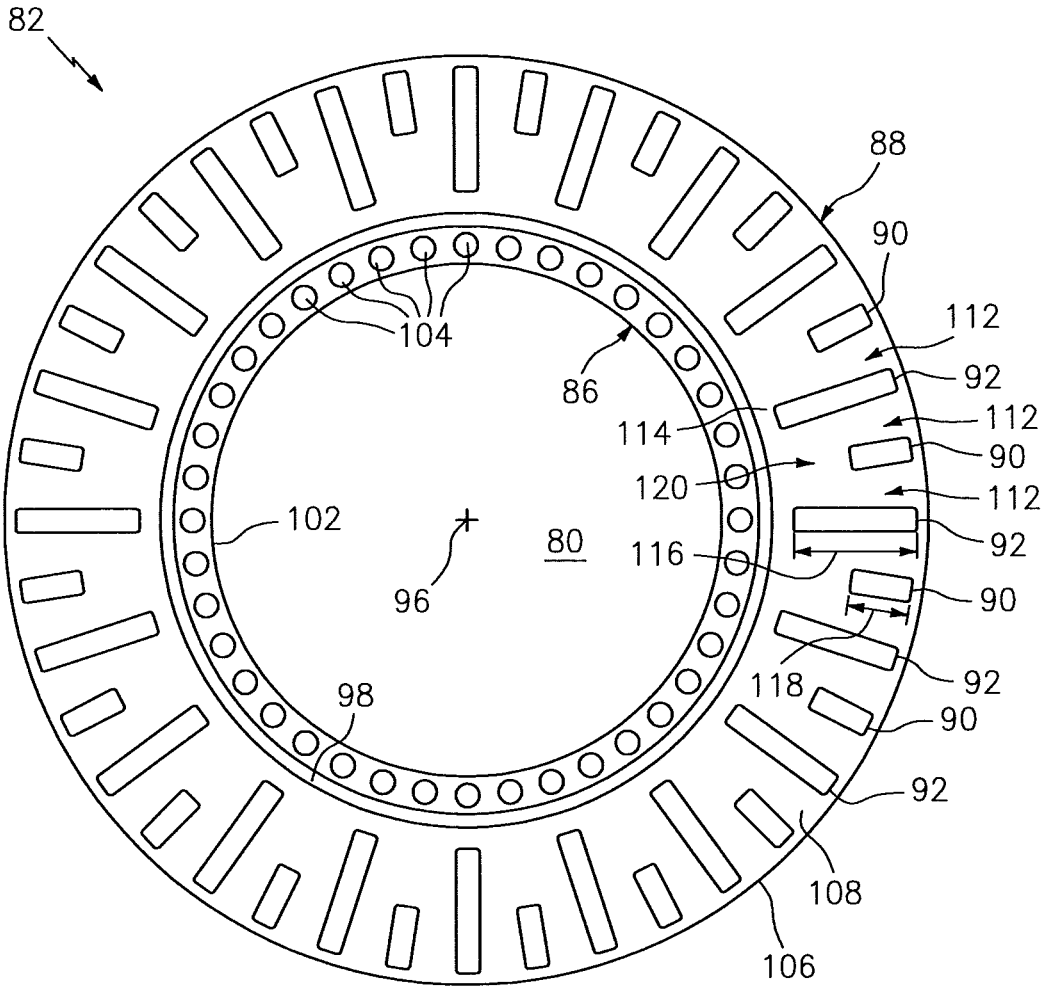
FIG. 4 is an upstream view illustration of a guide/shield structure.

Referring to FIGS. 3 and 4, the base 86 extends along an axis 96 between a first end 98 and a second end 100. The first end 98 may be arranged upstream of the second end 100 and adjacent the plenum 56. The second end 100 may be arranged downstream of the first end 98 and adjacent the combustion chamber 48. With this arrangement, the base 86 projects axially through the respective aperture 78 in the bulkhead 62.

The base 86 includes a generally cylindrical inner surface 102 which at least partially defines the bore 80 axially through the fuel injector guide 68. The base 86 may also include one or more fluid flow passages 104. These passages 104 are arranged around the axis 96. Each of the passages 104 extends axially through the base 86 from its inlet at the first end 98 to its outlet at the second end 100. Each passage 104 is operable direct some of the core air from the plenum 56 into the combustion chamber 48, where the flow of this core air may convectively cool the base 86.

The flange 88 is connected to the base 86 at (e.g., on, contiguous with or proximate) the second end 100. The flange 88, for example, extends radially out from the base 86 to an outer peripheral edge 106. The flange 88 extends axially between opposing sides 108 and 110, which side 110 may be axially aligned with the first end 98 of the base 86 and adjacent the combustion chamber 48. The flange 88 extends circumferentially around the base 86.

The ribs 90 and 92 are disposed around the base 86. Each of the ribs 90, 92 extends axially out from the flange 88 towards the first end 98 of the base 86. More particularly, each rib 90, 92 extends axially from the side 108 to a distal end which engages (e.g., contacts) the bulkhead 62 (see FIG. 3). Each rib 90, 92 extends radially towards (or to) the peripheral edge 106. With this configuration, each pair of circumferentially adjacent ribs (e.g., 90 and 92) at least partially circumferentially defines a radially extending flow channel 112 therebetween. This flow channel 112 is axially defined between the flange 88 and the bulkhead 62. The flow channel 112 extends and/or is fluidly coupled radially between an annular chamber 114, between the base 86 and the bulkhead 62, and the outlet 74 into the combustion chamber 48.

Referring to FIG. 4, one or more of the ribs (e.g., every other rib 92) may have a first radial length 116. One or more of the ribs (e.g., the remaining ribs 90) may have a second radial length 118 that is different (e.g., less than) the first radial length 116. With such a configuration, adjacent portions of the ribs 92 flanking each rib 90 may circumferentially define a wide flow channel 120, which is split into a pair of the flow channels 112 by the respective rib 90. Of course, in other embodiments, the first radial length 116 may be substantially equal to the second radial length 118; e.g., each rib 90 and 92 may have substantially the same radial length.

Referring to FIG. 5, at least one of the one or more flow turbulators 94 may be disposed in one, some or each of the flow channels 112 and/or 120. The flow turbulators 94 of FIG. 5, for example, are arranged into one or more groupings; e.g., arrays. Each of these flow turbulator 94 groupings may include the same quantity of flow turbulators 94. Alternatively, at least one of the flow turbulator 94 groupings may include a different quantity of flow turbulators 94 than another one of the flow turbulator 94 groupings. Referring still to FIG. 5, each of the flow turbulator 94 groupings is disposed between a respective circumferentially adjacent pair of the ribs 90 and 92 or 92 and 92 and, thus, within a respective one of the flow channels 112 or 120.

Referring to FIGS. 3 and 5, each of the flow turbulators 94 is configured to turbulate air flowing through its associated flow channel 112, 120. Each flow turbulator 94, for example, may extend partially axially into its associated flow channel 112, 120 such that an air gap is axially between the turbulator 94 and the bulkhead 62. With such a configuration, air flowing through the flow channel 112, 120 is diverted around the flow turbulator 94 (e.g., through the gap). This flow diversion may generate turbulence (e.g., vortices) within the flowing air which may in turn increase convective heat transfer between the now turbulent air and the flange 88. The flow turbulators 94 may also increase the structural rigidity of the flange 88 and thereby reduce flange 88 thermal deformation during engine operation.

One or more of the flow turbulators 94 may each be configured as a trip strip (see FIGS. 5 and 6) and/or a pedestal (see FIG. 7). An example of a trip strip is an elongated protrusion with a compound (e.g., chevron) shape as illustrated in FIG. 5. Another example of a trip strip is an elongated protrusion with a linear shape as illustrated in FIG. 6. Referring to FIGS. 5 and 6, one or more of the trip strips may extend substantially completely across the respective flow channel (e.g., 112). One or more of the trip strips may also or alternatively extend partially across the respective flow channel (e.g., 120). Referring now to FIG. 7, an example of a pedestal is a point protrusion, a pin or a column. The pedestal may be hemispherical or any other shape.

Referring to FIG. 3, air such as core air from the plenum 56 may be fed into the chamber 114 and, thus, the flow channels 112 and 120 through one or more apertures 122. These apertures 122 may be configured as impingement apertures to provide additional cooling to the guide/shield structure 82 and, more particularly, the flange 88. One or more of the apertures, for example, may be configured to direct jets of core air through the chamber 114 and onto region(s) of the flange side 108 radially between the base 86 and the features 90, 92, 94. Of course, in alternative embodiments, one or more of the apertures 122 may also or alternatively direct core air onto the base 86 and/or region(s) of the flange side 108 which include one or more of the features 90, 92, 94. In still alternative embodiments, one or more of the apertures 122 may be configured to generally diffuse the core air into the chamber 114.

Figure 8:
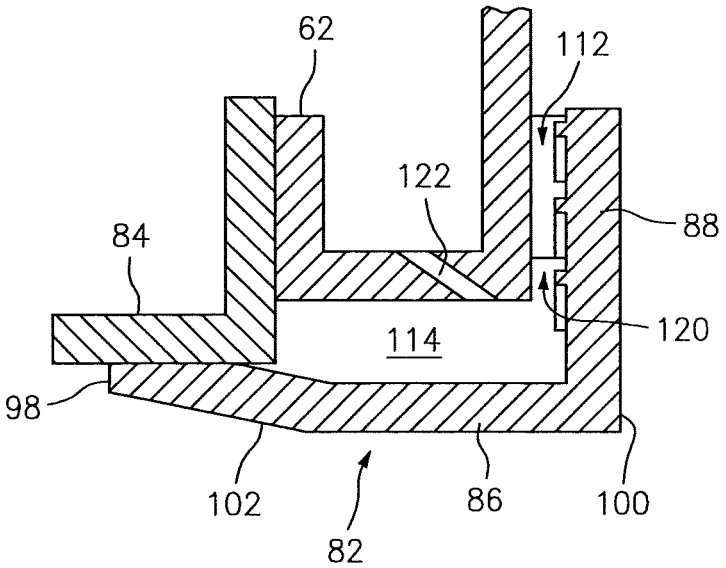
FIG. 8 is a partial, enlarged side sectional illustration of another combustor assembly.
Figure 9:
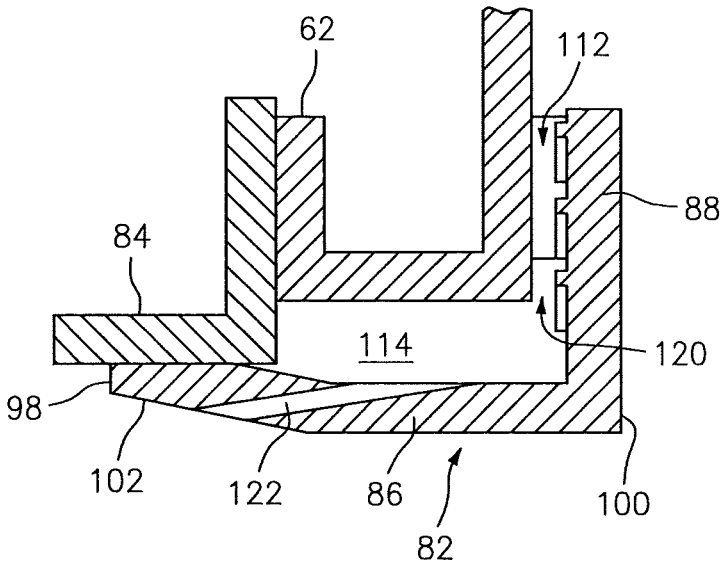
FIG. 9 is a partial, enlarged side sectional illustration of still another combustor assembly.

One or more of the apertures 122 may be defined and extend completely (or partially) through the retainer 84. Referring to FIG. 8, one or more of the apertures 122 may also or alternatively be defined and extend completely (or partially) through the bulkhead 62. Referring to FIG. 9, one or more of the apertures 122 may also or alternatively be defined and extend completely (or partially) through a portion of the guide/shield structure 82 such as the base 86.

Referring to FIG. 3, the retainer 84 is mated with (e.g., thread onto) the base 86 at the first end 98. An annular channel (generally at 78, 114) therefore is axially defined between the retainer 84 and the flange 88. This channel receives a portion of the bulkhead 62 which defines the aperture 78. The retainer 84 may be configured to clamp the bulkhead 62 portion between the retainer 84 and the flange 88. The retainer 84 may also or alternatively be directly fastened and/or bonded to the bulkhead 62 portion.

In some embodiments, each of the flow turbulators 94 may have substantially identical configurations (e.g., sizes, shapes, relative orientations, etc.) as shown in FIGS. 5 and 7. In other embodiments, at least one of the flow turbulators 94 may have a different configuration than another one of the flow turbulators 94; e.g., a different length as shown in FIG. 6, a different shape, etc. These different flow turbulators 94 may be arranged within the same flow channel, or similarly grouped into different flow channels.

In some embodiments, each of the flow turbulators 94 may be included with the guide/shield structure 82 as described above. However, in other embodiments, one or more of the flow turbulators 94 may be included with and extend out from the bulkhead 62.

The combustor assembly 52 may be included in various turbine engines other than the one described above. The combustor assembly 52, for example, may be included in a geared turbine engine where a gear train connects one or more shafts to one or more rotors in a fan section, a compressor section and/or any other engine section. Alternatively, the combustor assembly 52 may be included in a turbine engine configured without a gear train (see FIG. 1). The combustor assembly 52 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present disclosure therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. A fuel injector guide for a turbine engine combustor, comprising:

a tubular base extending along an axis between first and second ends;

an annular flange extending radially out from the base at the second end;

a plurality of ribs disposed around the base and extending axially out from the flange towards the first end, the ribs comprise a plurality of first ribs and a plurality of second ribs, wherein each of the first ribs has a first radial length, wherein one of the first ribs is disposed circumferentially between and adjacent to each second rib in a pair of the second ribs such that the one of the first ribs is the only rib circumferentially between the pair of the second ribs, wherein each of the second ribs has a second radial length, wherein one of the second ribs is disposed circumferentially between and adjacent to each first rib in a pair of the first ribs such that the one of the second ribs is the only rib circumferentially between the pair of the first ribs, and wherein the second radial length is different from the first radial length; and a flow turbulator disposed between an adjacent pair of the ribs;

wherein the flow turbulator comprises a trip strip.

2. The fuel injector guide of claim 1, wherein the flow turbulator has an axial thickness less than an axial thickness of each of the adjacent pair of the ribs.

3. The fuel injector guide of claim 1, wherein the trip strip extends completely across a flow channel defined between the adjacent pair of the ribs.

4. The fuel injector guide of claim 1, wherein the flow turbulator is one of a plurality of flow turbulators between the adjacent pair of the ribs.

5. The fuel injector guide of claim 1, further comprising a second flow turbulator disposed between another adjacent pair of the ribs.

6. The fuel injector guide of claim 5, wherein the flow turbulator and the second flow turbulator have substantially identical configurations.

7. The fuel injector guide of claim 5, wherein the flow turbulator and the second flow turbulator have different configurations.

8. The fuel injector guide of claim 1, wherein the ribs extend radially towards, but not to, an outer peripheral edge of the flange.

9. The fuel injector guide of claim 1, wherein a passage extends axially through a sidewall of the base to an outlet at the second end.

10. The fuel injector guide of claim 1, further comprising an annular retainer attached to the base at the first end, wherein an annular channel extends axially within the fuel injector guide between the flange and the retainer.

11. An assembly for a turbine engine combustor, comprising:

a bulkhead with a plurality of impingement apertures;

a fuel injector guide including a base and a flange, the base extending through the bulkhead along an axis and away from the flange, the flange projecting radially out from the base to a distal outermost circular peripheral edge of the fuel injector guide, wherein a plurality of radially extending flow channels are axially between the flange and the bulkhead and disposed around the base, wherein the flow channels are fluidly coupled with the impingement apertures, and wherein the fuel injector guide includes a plurality of ribs; and a flow turbulator extending partially axially into one of the flow channels that is bound by an adjacent pair of the ribs, wherein the flow turbulator comprises a trip strip that extends circumferentially and radially inwards to a first rib of the adjacent pair of the ribs;

the ribs comprising a plurality of first ribs and a plurality of second ribs;

each of the first ribs having a first radial length;

each of the first ribs disposed circumferentially between a respective pair of the second ribs and adjacent to each second rib in the respective pair of the second ribs;

each of the second ribs having a second radial length is different from the first radial length; and each of the second ribs disposed circumferentially between a respective pair of the first ribs and adjacent to each first rib in the respective pair of the first ribs.

12. The assembly of claim 11, wherein the fuel injector guide includes the flow turbulator.

13. The assembly of claim 11, wherein the trip strip is a linear trip strip.

14. The assembly of claim 11, wherein the trip strip is a chevron trip strip.

* * * * *